US008291963B1

(12) United States Patent
Trinks et al.

(10) Patent No.: US 8,291,963 B1
(45) **Date of Patent: *Oct. 23, 2012**

(54) HYBRID CORE ASSEMBLY

(75) Inventors: Steven W. Trinks, Wallingford, CT (US); Tracy A. Proctor-Hinckley, Manchester, CT (US); Steven J. Bullied, Pomfret Center, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/196,989

(22) Filed: Aug. 3, 2011

(51) Int. Cl.
*B22C 9/10* (2006.01)

(52) U.S. Cl. ..... 164/369; 164/516

(58) Field of Classification Search ..... 164/28, 164/516, 361, 369

See application file for complete search history.

(56) References Cited

U.S. PATENT DOCUMENTS

| | | | | |
|---|---|---|---|---|
| 7,108,045 | B2 | 9/2006 | Wiedemer et al. | |
| 7,270,170 | B2 | 9/2007 | Beals et al. | |
| 7,303,375 | B2 * | 12/2007 | Cunha et al. | 416/90 R |
| 7,673,669 | B2 | 3/2010 | Snyder et al. | |
| 7,866,370 | B2 | 1/2011 | Cunha | |
| 2007/0068649 | A1 | 3/2007 | Verner et al. | |
| 2007/0221359 | A1 | 9/2007 | Reilly | |
| 2009/0000754 | A1 | 1/2009 | Piggush | |
| 2010/0122789 | A1 | 5/2010 | Piggush et al. | |
| 2010/0284816 | A1 | 11/2010 | Propheter-Hinckley et al. | |

* cited by examiner

*Primary Examiner* — Kuang Lin
(74) *Attorney, Agent, or Firm* — Carlson, Gaskey & Olds

(57) ABSTRACT

A hybrid core assembly for a casting process includes a ceramic core portion and a refractory metal core portion that interfaces with a ceramic core trough of the ceramic core portion. The refractory metal core portion includes a finger having a bent portion that establishes a refractory metal core trough aligned with the ceramic core trough.

19 Claims, 6 Drawing Sheets

HYBRID CORE ASSEMBLY

This invention was made with government support under Contract No. N0019-02-c-3003 awarded by the United States Navy. The Government has certain rights in this invention.

BACKGROUND

This disclosure relates to a core assembly, and more particularly to a hybrid core assembly employed in a casting process to manufacture a part.

Gas turbine engines are widely used in aircraft propulsion, electric power generation, ship propulsion and pumps. Many gas turbine engine components are cast in a casting process. One example casting process is investment casting. Investment casting can form metallic parts having relatively complex geometries, such as gas turbine engine parts requiring internal cooling passageways. Blades and vanes are examples of such parts.

The investment casting process utilizes a mold having one or more mold cavities that include a shape generally corresponding to the part to be cast. A wax or ceramic pattern of the part is formed by molding wax or injecting ceramic material over a core assembly. In a shelling process, a shell is formed around the core assembly. The shell is fired to harden the shell such that the mold is formed comprising the shell having one or more part defining compartments that include the core assembly. Molten material is communicated into the mold to cast the part. The shell and core assembly are removed once the molten material cools and solidifies.

SUMMARY

A hybrid core assembly for a casting process includes a ceramic core portion and a refractory metal core portion that interfaces with a ceramic core trough established by the ceramic core portion. The refractory metal core portion includes a finger having a bent portion that establishes a refractory metal core trough that is aligned with the ceramic core trough.

In another exemplary embodiment, a hybrid core assembly for a casting process includes a ceramic core portion and a refractory metal core portion. The refractory metal core portion includes a finger having a bent portion that is received within a ceramic core trough. A first section of the bent portion extends along a first sidewall of the ceramic core trough and a second section of the bent portion extends along a second sidewall of the ceramic core trough opposite from the first sidewall.

In yet another exemplary embodiment, a method of assembling a hybrid core assembly for a casting process includes bending a portion of a finger of the refractory core portion and inserting the bent portion into a ceramic core trough of a ceramic core portion to establish a refractory metal core trough. A plug is positioned within a void established by the refractory metal core trough.

The various features and advantages of this disclosure will become apparent to those skilled in the art from the following detailed description. The drawings that accompany the detailed description can be briefly described as follows.

DETAILED DESCRIPTION

Figure 1:
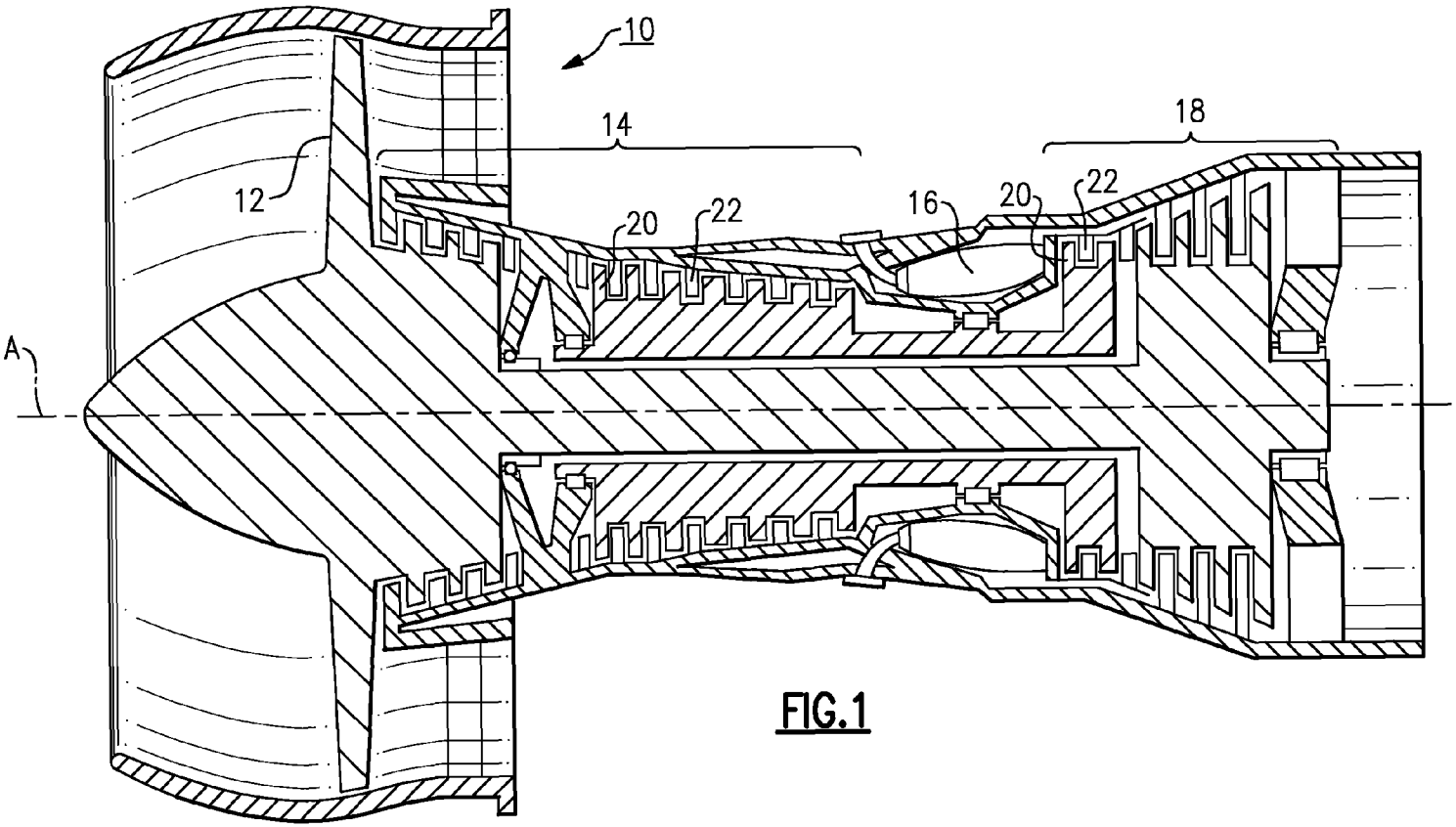
FIG. 1 shows a schematic view of a gas turbine engine.

FIG. 1 illustrates an example gas turbine engine 10 that is circumferentially disposed about an engine centerline axis A. The gas turbine engine 10 includes (in serial flow communication) a fan section 12, a compressor section 14, a combustor section 16 and a turbine section 18. Generally, during operation, air is compressed in the compressor section 14 and is mixed with fuel and burned in the combustor section 16. The combustion gases generated in the combustor section 16 are discharged through the turbine section 18, which extracts energy from the combustion gases to power the compressor section 14, the fan section 12, and other gas turbine engine loads.

The gas turbine engine 10 includes a plurality of parts that can be manufactured in a casting process, such as an investment casting process or other suitable casting process. For example, both the compressor section 14 and the turbine section 18 include alternating rows of rotating blades 20 and stationary vanes 22 that can be manufactured in a casting process. The blades 20 and the vanes 22, especially those in the turbine section 18, are subjected to repetitive thermal cycling under widely ranging temperatures and pressures. Therefore, these parts may require internal cooling passages for cooling the part during engine operation. Example hybrid core assemblies for casting a part that includes such internal cooling passages are discussed below.

This view is highly schematic and is included to provide a basic understanding of the gas turbine engine 10 rather than limit the disclosure. This disclosure extends to all types of gas turbine engine and to all types of applications.

Figure 2:
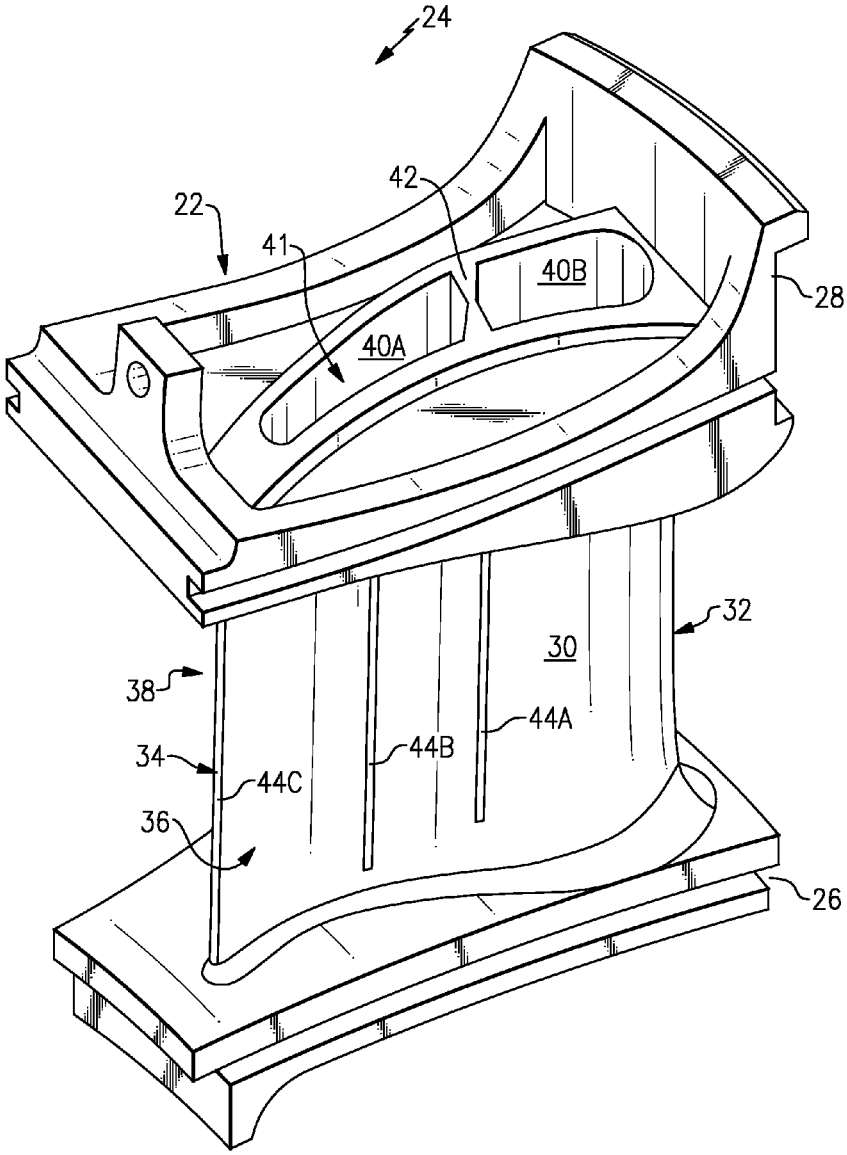
FIG. 2 illustrates a gas turbine engine part that can be manufactured in a casting process.

FIG. 2 illustrates a part 24 that can be cast in a casting process such as an investing casting process. In this example, the part 24 is a vane 22 of the turbine section 18. Although the part 24 is illustrated as a vane 22 of the turbine section 18, the various features of this disclosure are applicable to any cast part of a gas turbine engine, or any other part.

The part 24 includes an inner diameter platform 26, an outer diameter platform 28, and an airfoil 30 that extends between the inner diameter platform 26 and the outer diameter platform 28. The airfoil 30 includes a leading edge 32, a trailing edge 34, a pressure side 36 and a suction side 38. Although a single airfoil is depicted, other parts are also contemplated, including parts having multiple airfoils (i.e., vane doublets).

The part 24 can include internal cooling passages 40A, 40B that are separated by a rib 42. The internal cooling passages 40A, 40B include refractory metal core formed cavities that exit the airfoil 30 at slots 44A, 44B and 44C. The internal cooling passages 40A, 40B and their respective refractory metal core formed cavities define an internal circuitry 41 for cooling the part 24. The internal cooling passages 40A, 40B and the internal circuitry 41 of the part 24 represent one example of many potential cooling circuits. Various alternative cooling passages and internal circuitry configurations could alternatively be cast in the part 24.

In operation, cooling airflow, such as bleed airflow from the compressor section 14, is communicated through the internal cooling passages 40A, 40B and out of the slots 44A, 44B and 44C to cool the airfoil 30 from the hot gases that are communicated between the leading edge 32 and the trailing edge 34 of the airfoil 30 and across its pressure side 36 and suction side 38. The cooling airflow is circulated through the internal circuitry 41 to cool the part 24.

Figure 3:
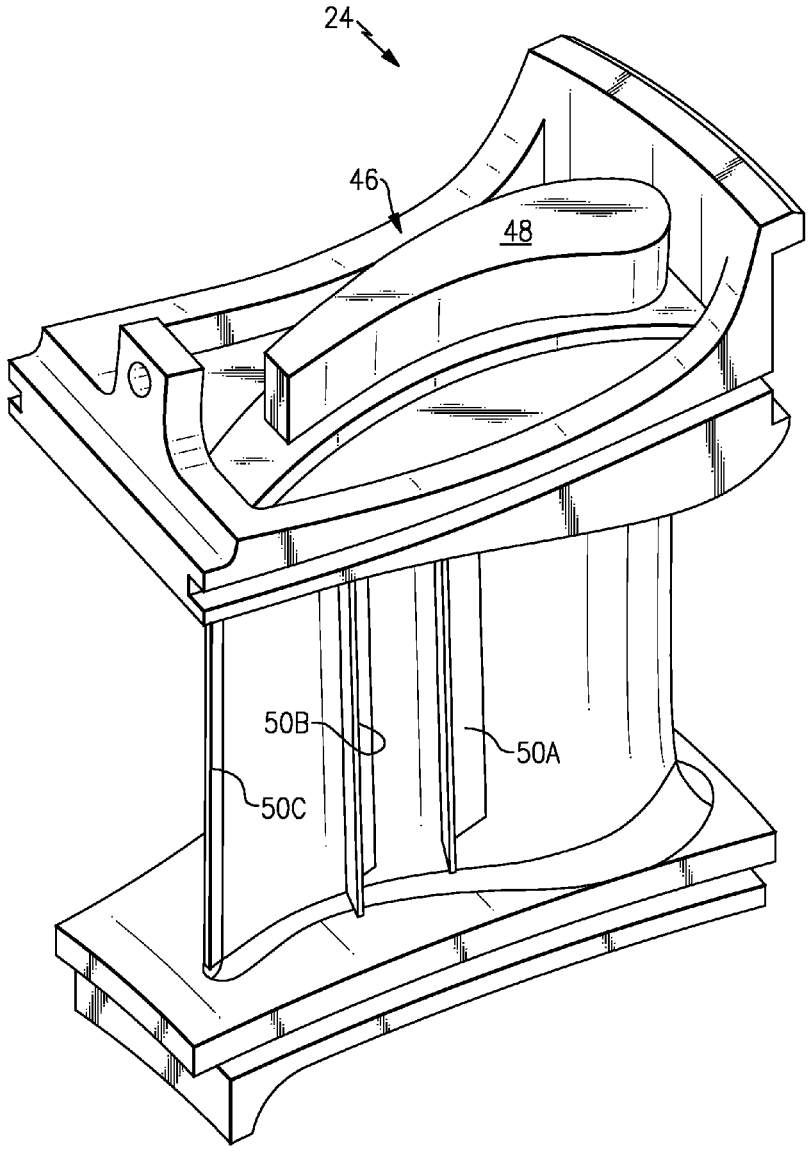
FIG. 3 illustrates the part of FIG. 2 prior to removal of a core assembly.

FIG. 3 illustrates the part 24 of FIG. 2 prior to removal of a hybrid core assembly 46 that is used during the casting process to define the internal cooling passages 40A, 40B and the internal circuitry 41 of the part 24. In this disclosure, the term "hybrid core assembly" is intended to describe an assembled core assembly for a casting process that includes at least a ceramic core portion and a refractory metal core (RMC) portion. A refractory metal core is a core that is made out of a refractory metal such as molybdenum, niobium, tantalum, tungsten, rhenium or other like material. The ceramic core portion can include any suitable ceramic.

In this example, the hybrid core assembly 46 includes multiple RMC portions 50A, 50B, and 50C attached to a ceramic core portion 48. The RMC portions 50A, 50B are skin cores, and the RMC portion 50C is a trailing edge core. Although three RMC portions 50A, 50B, and 50C are illustrated, the actual number of RMC portions is dependent on the cooling requirements of the part 24. For example, the hybrid core assembly 46 could include only a single RMC portion or greater than three RMC portions.

Once removed from the part 24, such as during a leaching operation, the ceramic core portion 48 forms the internal cooling passages 40A, 40B and the rib 42 (see FIG. 2) of the part 24. Removal of the RMC portions 50A, 50B, and 50C in a post-cast operation renders the slots 44A, 44B and 44C that jut out from the airfoil 30 and various other cavities that define the internal circuitry 41 of the part 24 (see FIG. 2).

Figure 4:
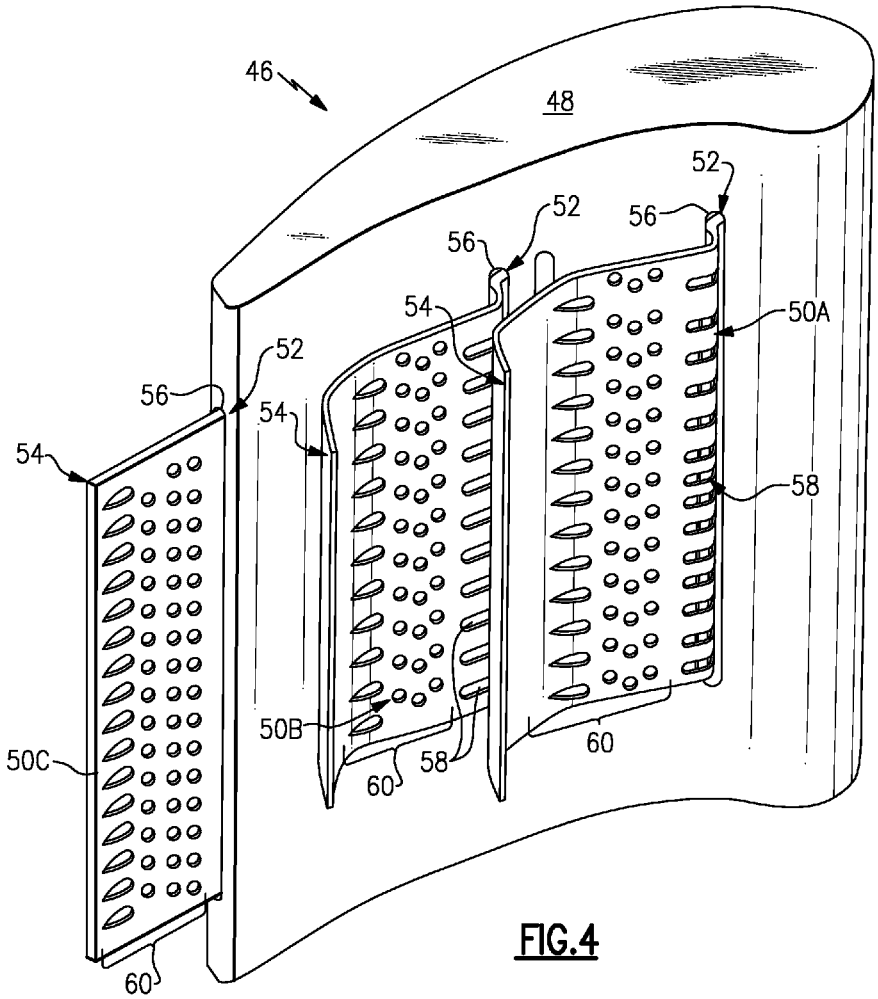
FIG. 4 illustrates a hybrid core assembly for a casting process.

FIG. 4 illustrates an assembled hybrid core assembly 46 that includes the ceramic core portion 48 and RMC core portions 50A, 50B and 50C. Each RMC portion 50A, 50B and 50C includes entrance ends 52 and exit ends 54. The entrance ends 52 interface with ceramic core troughs 56 (here, three separate troughs to accommodate the RMC core portions 50A, 50B and 50C) formed in the ceramic core portion 48. The ceramic core troughs 56 are receptacles for receiving the RMC portions 50A, 50B and 50C. The length, depth, geometry and configuration of the ceramic core troughs 56 can vary. Additionally, the ceramic core troughs 56 can be cast or machined into the ceramic core portion 48. The exits ends 54 of the RMC portions 50A, 50B and 50C represent the portions that jut out from the airfoil 30 (see FIG. 3).

The entrance ends 52 of the RMC portions 50A, 50B and 50C can include a plurality of cut-in features 58 that dictate the amount of airflow that is fed into the entrance ends 52 for cooling the part 24. The example RMC portions 50A, 50B and 50C also include a plurality of features 60 that further define the internal circuitry 41 ultimately cast into the part 24. The RMC portions 50A, 50B and 50C can further include a coating, such as an aluminide coating, that protects against adverse chemical reactions that may occur during a casting process.

Figure 5:
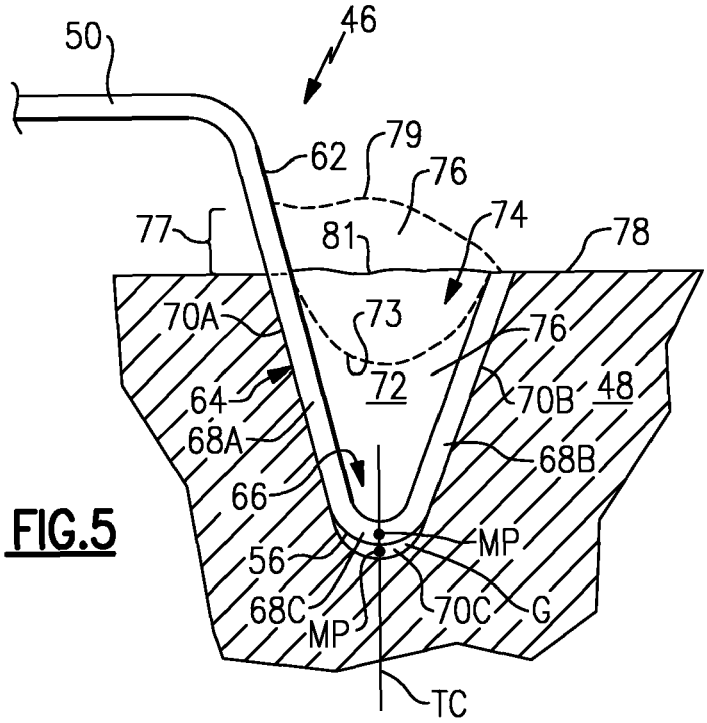
FIG. 5 illustrates various aspects of the hybrid core assembly of FIG. 4.

FIG. 5 illustrates additional aspects of the example hybrid core assembly 46. The RMC portion 50 includes one or more fingers 62 that are received in the ceramic core trough(s) 56 of the ceramic core portion 48. Each finger 62 includes a bent portion 64. The bent portion 64 can include a U-shaped design, although other designs are contemplated.

The bent portion 64 includes a first section 68A, a second section 68B and a bridge section 68C that together establish a uniform, single-piece construction. The bridge section 68C connects the first section 68A and the second section 68B. The bridge section 68C can include a curved shape to connect the first section 68A and the second section 68B.

The first section 68A extends generally along a sidewall 70A of the ceramic core trough 56, while the second section 68B extends along an opposite sidewall 70B. The sidewalls 70A, 70B are opposite one another (in cross-section) and define the ceramic core trough 56. A bridge wall 70C of the ceramic core trough 56 extends between the sidewalls 70A, 70B on a radially inner side of the ceramic core trough 56. A small gap G can extend between the bridge section 68C and the bridge wall 70C, although the gap G is not a necessary feature of the hybrid core assembly 46.

The bent portion 64 establishes a refractory metal core (RMC) trough 66 that is aligned with the ceramic core trough 56. In other words, the bridge section 68C of the bent portion 64 is axially aligned with a bride wall 70C of the ceramic core trough 56 such that a trough centerline axis TC extends through a midpoint MP of the bridge section 68C and the bridge wall 70C.

The RMC trough 66 establishes a void 72 that receives a plug 74. In this example, the plug 74 includes an adhesive 76 that is communicated into the RMC trough 66.

The hybrid core assembly 46 can be assembled by providing the finger(s) 62 of the RMC portions 50 with bent portions 64 for each RMC portion that must be attached to the ceramic core portion 48 (except for any trailing edge RMC portion, which does not necessarily require such attachment). The bent portion 64 of the finger 62 is inserted into the ceramic core trough 56 of the ceramic core portion 48 to establish the RMC trough 66. The bent portion 64 can be tacked into place using an adhesive or can be press-fit into the ceramic core trough 56.

The plug 74 is received in the void 72 of the RMC trough 66 to fully assemble the hybrid core assembly 46. The plug 74 can be received in the void 72 either before or after the fingers 62 of the RMC portions 50 are inserted into the ceramic core trough 56.

In this embodiment, the adhesive 76 is poured into the void 72 to cure the plug 74 in place. The adhesive 76 may shrink to a reduced height 73 within the RMC trough 66 and therefore can be applied in multiple applications. Eventually, the adhesive 76 will mount to a desired height 79. The portion 77 of the adhesive 76 that extends above an outer surface 78 of the ceramic core portion 48 is removed such that an outer plug surface 81 of the plug 74 aligns with the exterior surface 78 (i.e., the outer plug surface 81 does not extend radially outward of the exterior surface 78).

Figure 6A:
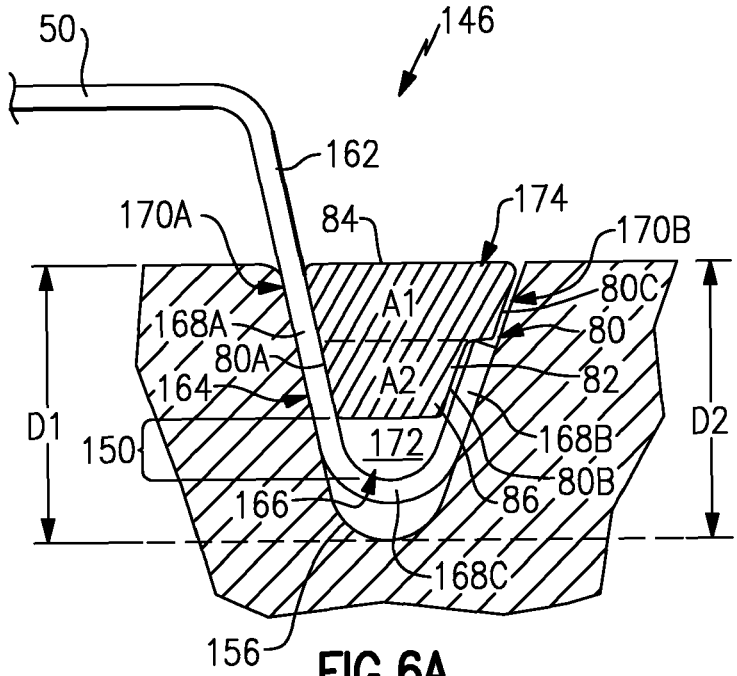
FIGS. 6A, 6B and 6C illustrate additional hybrid core assemblies.
Figure 6B:
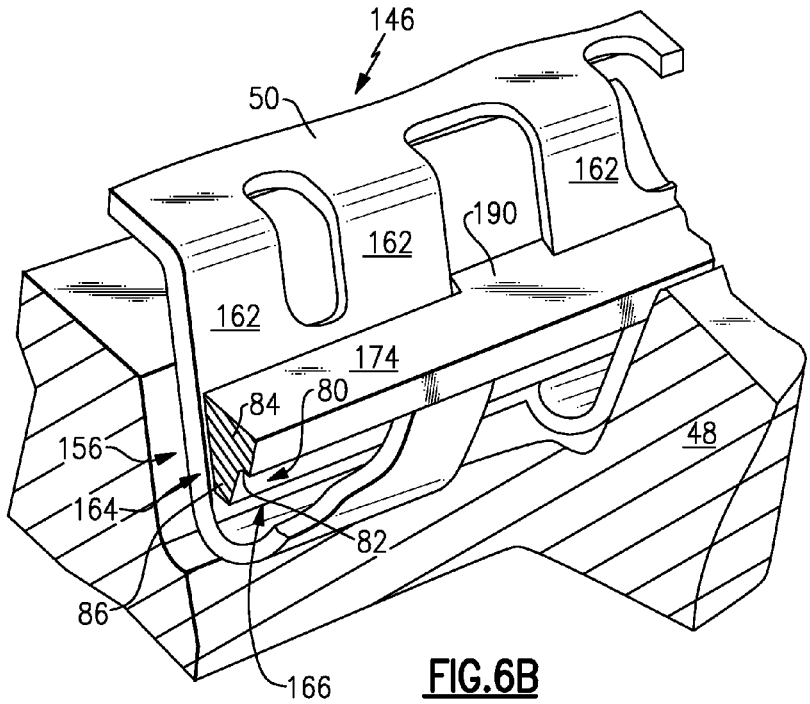

FIGS. 6A and 6B illustrate another example hybrid core assembly 146. The exemplary hybrid core assembly 146 requires a relatively limited amount of adhesive (or no adhesive at all) to attach the RMC portions(s) 50 to the ceramic core portion 48.

For example, the hybrid core assembly 146 includes fingers 162 having bent portions 164. In this example, the bent portions 164 are generally J-shaped. The bent portions 164 each define a refractory metal core (RMC) trough 166 having a void 172. The bent portions 164 include a first section 168A, a second section 168B, and a bridge section 168C that connects the first section 168A and the second section 168B. The first section 168A extends generally along an entire depth D1 of a first sidewall 170A of the ceramic core trough 156. The second section 168B; however, extends along a portion of a sidewall 170B that is less than a depth D2 of the sidewall 170B. In other words, the hybrid core assembly 146 includes a shortened RMC trough 166.

A plug 174 is received within a void 172 of the RMC trough 166. In this example, the plug 174 fills only a portion of the void 172, whereas a section 150 of the void 172 is not filled.

The plug 174 can include a ceramic plug that is tacked into place using an adhesive. For example, the plug 174 can be tacked with the adhesive at surfaces 80A, 80B and 80C, or a drop of adhesive could be placed in the void 172. Alternatively, the plug 174 is press-fit into the RMC trough 166.

The surface 80B of the plug 174 is a stepped portion 80 that includes a recess 82. The second section 168B of the bent portion 164 is received against the stepped portion 80 within the recess 82. The stepped portion 80 divides the plug 174 into a radially outer portion 84 and a radially inner portion 86. The radially outer portion 84 of the plug 174 fills an area A1 of the void 172 and the radially inner portion 86 fills an area A2 of the void 172. The area A1 is a greater area than the area A2.

Figure 6C:
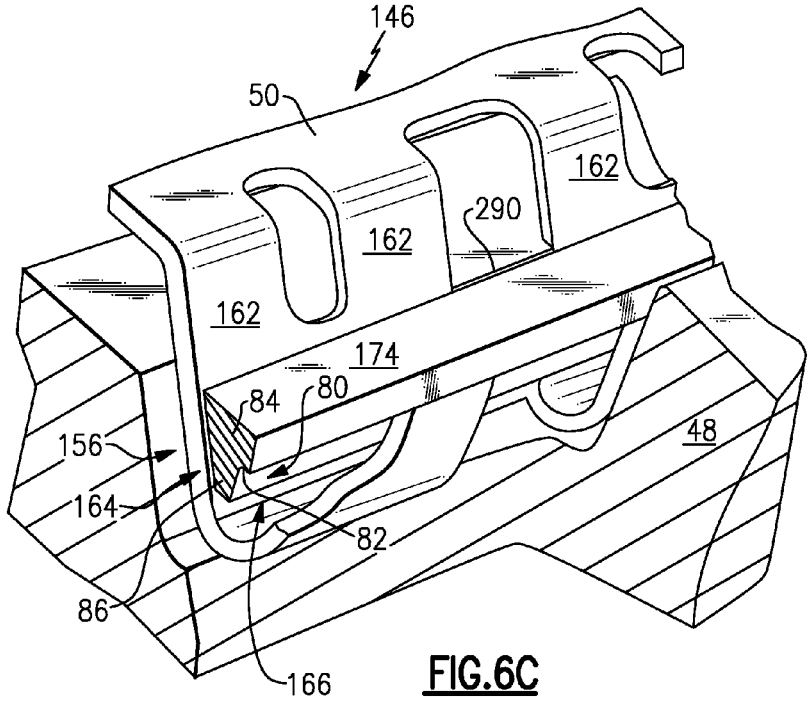

The plug 174 can also include protrusions 190 that extend between adjacent fingers 162 to cover the ceramic core trough 156 (See FIG. 6B). Alternatively, the ceramic core 48 establishes protrusions 290 which extend between adjacent fingers 162 to cover the ceramic core trough 156 (See FIG. 6C).

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A hybrid core assembly for a casting process, comprising:

a ceramic core portion that includes a ceramic core trough;

a refractory metal core portion that interfaces with said ceramic core trough, wherein said refractory metal core portion includes a finger having a bent portion received within said ceramic core trough that establishes a refractory metal core trough aligned with said ceramic core trough; and a plug received within a void of said refractory metal core trough.

2. The assembly as recited in claim 1, wherein said plug includes an adhesive.

3. The assembly as recited in claim 1, wherein said plug includes a ceramic plug.

4. The assembly as recited in claim 1, comprising a plug positioned within said refractory metal core trough, wherein said plug includes a stepped surface and said bent portion is received in a recess of said stepped surface.

5. The assembly as recited in claim 1, wherein said ceramic core trough establishes a first depth and said refractory metal core trough establishes a second depth that is less than said first depth.

6. The assembly as recited in claim 5, comprising a plug that is received within a void of said refractory metal core trough.

7. The assembly as recited in claim 1, wherein said bent portion is generally U-shaped.

8. A hybrid core assembly for a casting process, comprising:

a ceramic core portion;

a refractory metal core portion having a finger including a bent portion that is received within a ceramic core trough of said ceramic core portion, wherein a first section of said bent portion extends along a first sidewall of said ceramic core trough and a second section of said bent portion extends along a second sidewall of said ceramic core trough that is opposite from said first sidewall, wherein said bent portion defines a refractory metal core trough that is received within said ceramic core trough; and a plug received within a void of said refractory metal core trough.

9. The assembly as recited in claim 8, wherein either said plug or said ceramic core portion establishes a protrusion that extends between said finger and an adjacent finger of said refractory metal core portion.

10. The assembly as recited in claim 8, wherein said first section extends along a majority of a first portion of a first depth of said first sidewall and said second section extends along a second portion of a second depth of said second sidewall that is less than said first portion.

11. A method of assembling a hybrid core assembly for a casting process, comprising the steps of:

(a) providing a refractory metal core portion with a bent portion;

(b) inserting the bent portion into a ceramic core trough of a ceramic core portion to establish a refractory metal core trough; and (c) positioning a plug within a void established by the refractory metal core trough.

12. The method as recited in claim 11, wherein said step (c) comprises the step of:

filling the void with an adhesive.

13. The method as recited in claim 11, wherein said step (c) comprises the step of:

inserting a ceramic plug into the void.

14. The method as recited in claim 11, wherein said step (b) occurs prior to said step (c).

15. The method as recited in claim 11, wherein said step (c) occurs prior to said step (b).

16. A hybrid core assembly for a casting process, comprising:

a ceramic core portion that includes a ceramic core trough;

a refractory metal core portion that interfaces with said ceramic core trough, wherein said refractory metal core portion includes a finger having a bent portion that establishes a refractory metal core trough aligned with said ceramic core trough; and a plug received within a void of said refractory metal core trough.

17. A hybrid core assembly for a casting process, comprising:

a ceramic core portion that includes a ceramic core trough;

a refractory metal core portion that interfaces with said ceramic core trough, wherein said refractory metal core portion includes a finger having a bent portion that establishes a refractory metal core trough aligned with said ceramic core trough; and a plug positioned within said refractory metal core trough, wherein said plug includes a stepped surface and said bent portion is received in a recess of said stepped surface.

18. A hybrid core assembly for a casting process, comprising:

a ceramic core portion that includes a ceramic core trough;

a refractory metal core portion that interfaces with said ceramic core trough, wherein said refractory metal core portion includes a finger having a bent portion that establishes a refractory metal core trough aligned with said ceramic core trough; and said ceramic core trough establishes a first depth and said refractory metal core trough establishes a second depth that is less than said first depth.

19. A hybrid core assembly for a casting process, comprising:

a ceramic core portion;

a refractory metal core portion having a finger including a bent portion that interfaces with a ceramic core trough of said ceramic core portion, wherein a first section of said bent portion extends along a first sidewall of said ceramic core trough and a second section of said bent portion extends along a second sidewall of said ceramic core trough that is opposite from said first sidewall; and said first section extends along a majority of a first portion of a first depth of said first sidewall and said second section extends along a second portion of a second depth of said second sidewall that is less than said first portion.

* * * * *